US007445173B2

(12) United States Patent
Wang

(10) Patent No.: US 7,445,173 B2
(45) Date of Patent: Nov. 4, 2008

(54) DEVICE FOR REDUCING VIBRATIONS AND NOISES OF A PAPER SHREDDER

(75) Inventor: Tie-Chun Wang, SanChung (TW)

(73) Assignee: Michilin Prosperity Co., Ltd., San Chung, Taipei Hsien (TW)

( * ) Notice: Subject to any disclaimer, the term of this patent is extended or adjusted under 35 U.S.C. 154(b) by 0 days.

(21) Appl. No.: 11/819,009

(22) Filed: Jun. 25, 2007

(65) Prior Publication Data

US 2008/0135661 A1 Jun. 12, 2008

(30) Foreign Application Priority Data

Dec. 11, 2006 (CN) ..... 2006 2 0160365 U

(51) Int. Cl.
*B02C 1/08* (2006.01)
*B02C 7/04* (2006.01)
*B02C 13/20* (2006.01)

(52) U.S. Cl. ..... 241/236; 241/34; 241/285.1

(58) Field of Classification Search ..... 241/DIG. 30, 241/236, 285.1, 34, 225
See application file for complete search history.

(56) References Cited

U.S. PATENT DOCUMENTS 190,389 A * 5/1877 Trumbull ..... 241/230
315,583 A * 4/1885 Wild ..... 241/230
705,323 A * 7/1902 Creuzbaur ..... 241/141
4,817,877 A * 4/1989 Itoh et al. ..... 241/34
5,893,524 A * 4/1999 Schwelling ..... 241/167

FOREIGN PATENT DOCUMENTS

EP 10681 A1 * 5/1980

* cited by examiner

*Primary Examiner*—Bena Miller
(74) *Attorney, Agent, or Firm*—Bacon & Thomas, PLLC

(57) ABSTRACT

A device for reducing vibrations and noises of a paper shredder uses a buffer device comprised of a rubber cylinder and a spring between core fixing frames and the housing base of the paper shredder. The buffer device is fixed by using screw and washer, enhancing the vibration and noise reduction effect for the paper shredder.

2 Claims, 2 Drawing Sheets

DEVICE FOR REDUCING VIBRATIONS AND NOISES OF A PAPER SHREDDER

BACKGROUND OF THE INVENTION

1. Field of Invention

The invention relates to a paper shredder and, in particular, to a device for reducing the vibrations and noises of a paper shredder.

2. Related Art

With reference to FIGS. 1 and 2, the core assembly of a paper shredder includes two side fixing frames, a cutting assembly across the two fixing frames, a gear set for rotating the cutting assembly, and a motor for driving the gear set. When the core is disposed on the housing base, rubber pads are often inserted to reduce vibrations and noises produced when the core is running. There are various types of pads. Both the annular rubber pad in FIG. 1 and the flat stripe rubber pad in FIG. 2 have been used in the industry for many years. There is still room for improvements.

SUMMARY OF THE INVENTION

An objective of the invention is to reduce vibrations and noises of a paper shredder.

To achieve the above objective, the invention provides a device for reducing vibrations and noises of a paper shredder. A buffer device consisting of a rubber cylinder and a spring is inserted between the core fixing frames and the housing base. The buffer device is further fixed by using screw and washer, thereby enhancing the effect of vibration and noise reduction.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
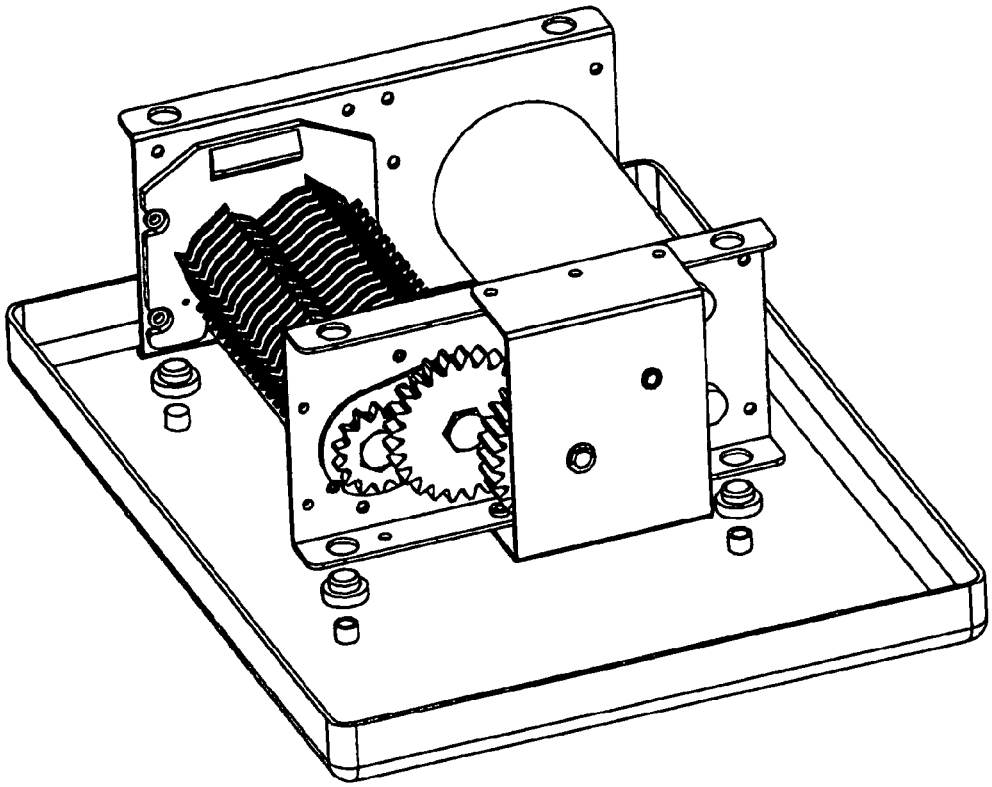
FIG. 1 is a three-dimensional exploded view of using a annular rubber to reduce vibrations and noises in the conventional paper shredders.
Figure 2:
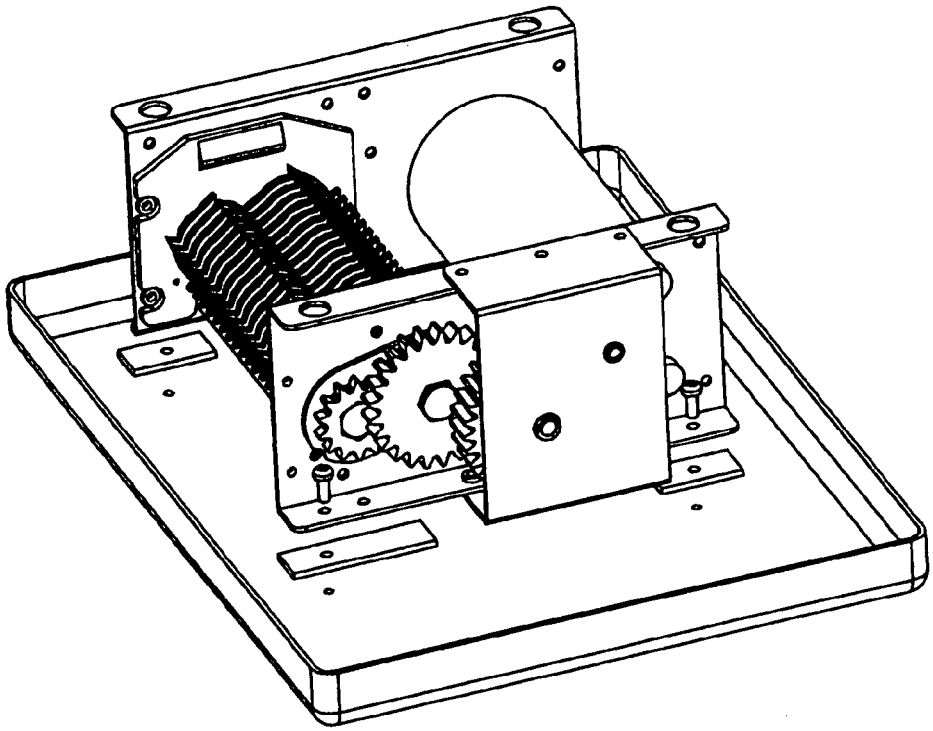
FIG. 2 is a three-dimensional exploded view of using a rubber flat strip pad to reduce vibrations and noises in the conventional paper shredders.
Figure 3:
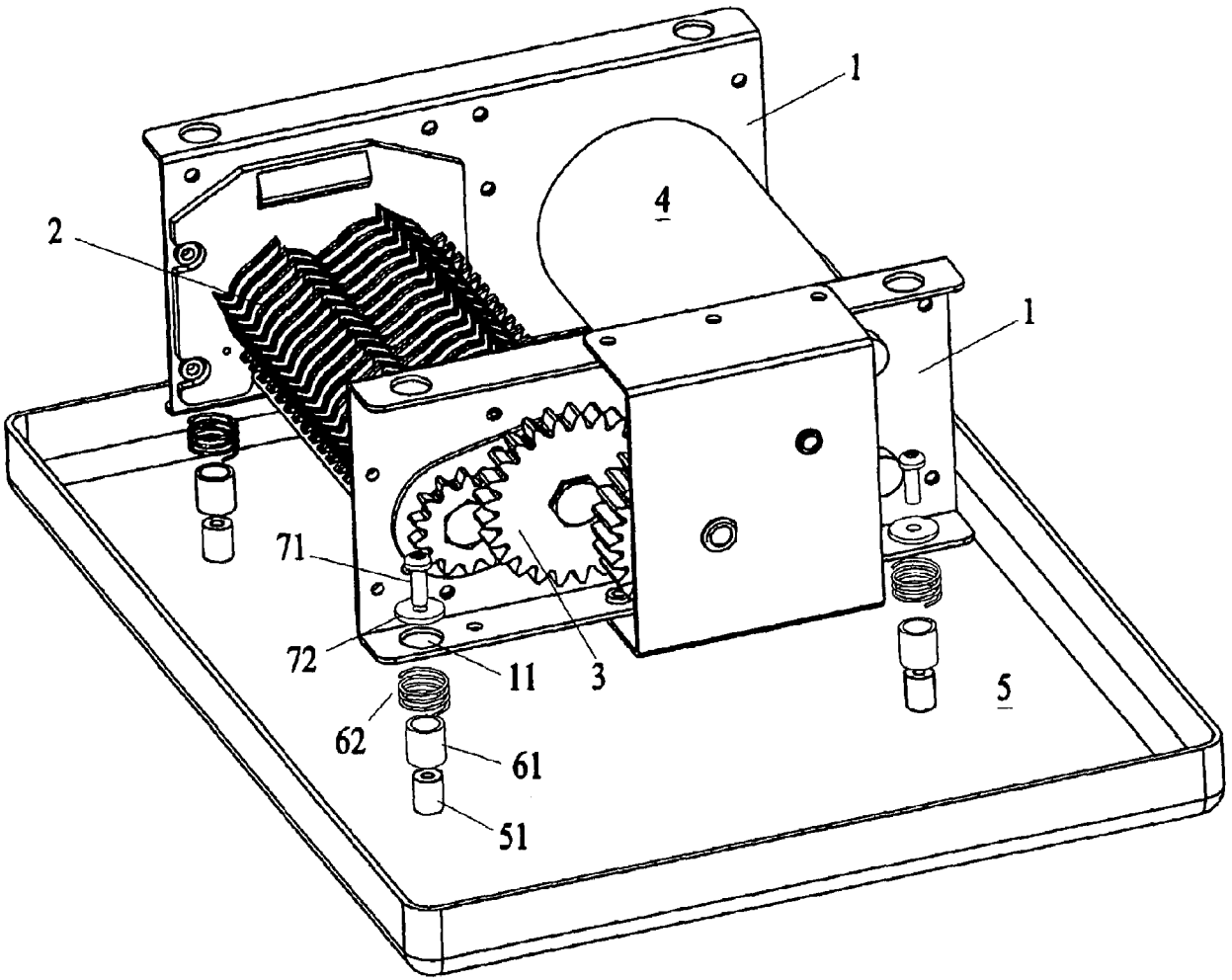
FIG. 3 is a three-dimensional exploded view of the disclosed buffer device of the invention.

Please refer to FIG. 3, the core assembly of the paper shredder includes two side fixing frames 1, a cutting assembly 2 across the two side fixing frames 1, a gear set 3 for rotating the cutting assembly 2, and a motor 4 for driving the gear set 3. To reduce vibrations and noises produced during the operation of the core assembly, when the core assembly is fixed on the housing base 5, a rubber cylinder 61 is mounted on the rod 51 of the housing base 5 and a spring 62 is disposed around the rubber cylinder 61 to form a buffer device. A screw 71 and a washer 72 go through a hole 11 of the fixing frame 1 and the buffer device. They are then fixed onto the rod 51.

With the help of the rubber cylinder and the spring, the above-mentioned buffer device can greatly reduce the vibrations and noises produced during the operation of the core assembly.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A device for reducing vibrations and noise of a paper shredder, comprising:

a core assembly, which has two side fixing frames, a cutting assembly across the two side fixing frames, a gear set for rotating the cutting assembly, and a motor for driving the gear set;

a housing base for supporting and fixing the core assembly;

a buffer device, disposed between the core assembly and the housing base for reducing the vibrations and noises produced during the operation of the core, said buffer device including a rubber cylinder disposed on a rod of the housing base and a spring mounted around the rubber cylinder; and a fixing element, which fixes the core assembly and the buffer device on the housing base.

2. The device of claim 1, wherein the fixing element includes a screw and a washer.

* * * * *